US007837860B1

(12) United States Patent
Hoehn et al.

(10) Patent No.: US 7,837,860 B1
(45) **Date of Patent: *Nov. 23, 2010**

(54) PROCESS FOR THE PRODUCTION OF LOW SULFUR DIESEL AND HIGH OCTANE NAPHTHA

(75) Inventors: Richard K. Hoehn, Mount Prospect, IL (US); Srinivasa G. Varadarajan, Schaumburg, IL (US); Douglas W. Kocher-Cowan, Lisle, IL (US)

(73) Assignee: UOP LLC, Des Plaines, IL (US)

( * ) Notice: Subject to any disclaimer, the term of this patent is extended or adjusted under 35 U.S.C. 154(b) by 1378 days.

This patent is subject to a terminal disclaimer.

(21) Appl. No.: 11/299,855

(22) Filed: Dec. 12, 2005

(51) Int. Cl.
*C10G 44/00* (2006.01)
*C10G 44/02* (2006.01)

(52) U.S. Cl. ..... 208/78; 208/80; 208/213; 208/107; 208/108; 208/209

(58) Field of Classification Search ..... 208/78, 208/80, 213, 107, 108, 209
See application file for complete search history.

(56) References Cited

U.S. PATENT DOCUMENTS 4,943,366 A 7/1990 Fischer et al. ..... 208/68

*Primary Examiner*—Thuan Dinh Dang
(74) *Attorney, Agent, or Firm*—James C Paschall

(57) ABSTRACT

A process for the production of low sulfur diesel and high octane naphtha. Separate high pressure vapor liquid separators serve to maintain and isolate the high octane naphtha produced in the hydrocracking zone thereby maximizing the value of the hydrocarbon streams produced.

17 Claims, 1 Drawing Sheet

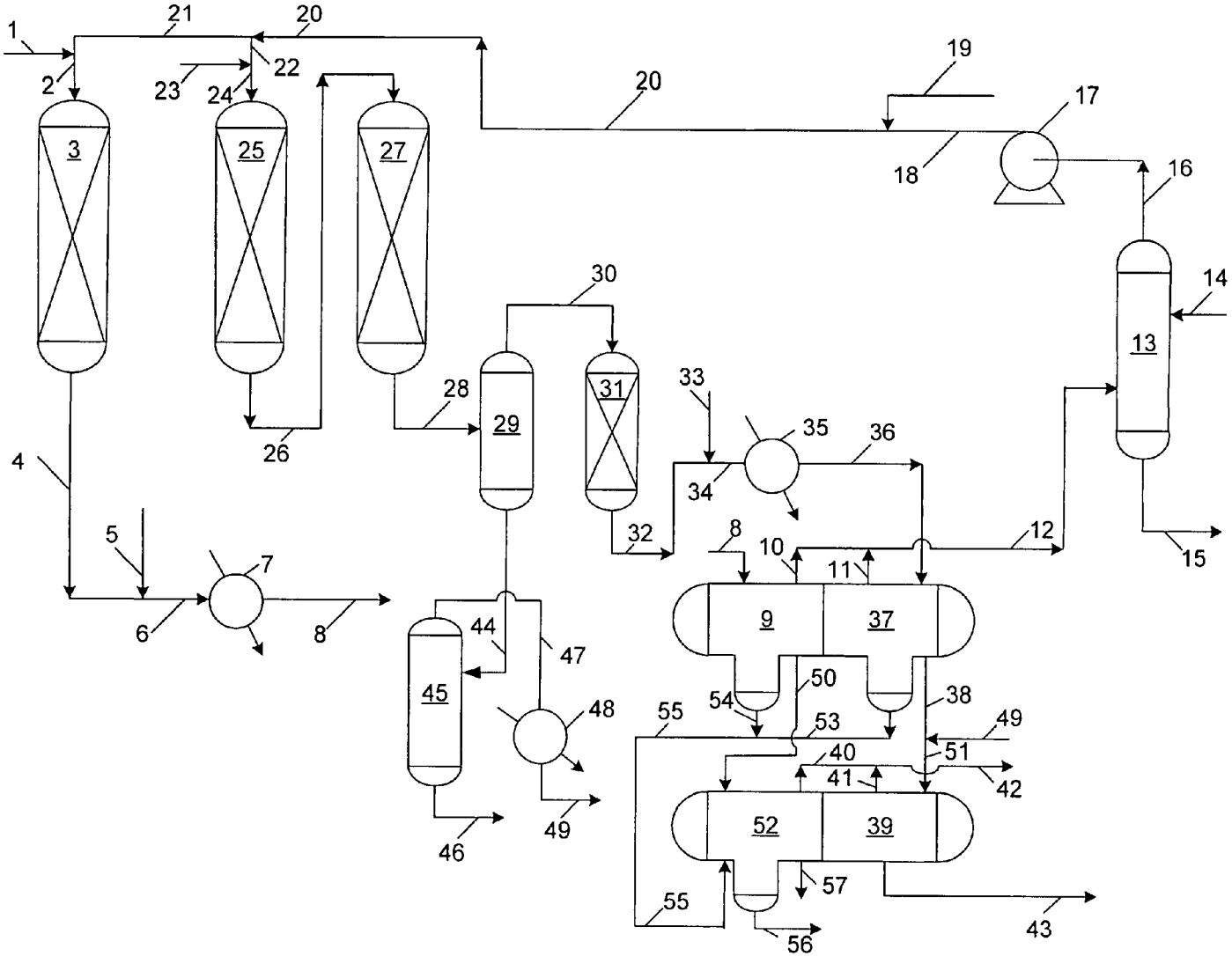
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
55
56
57

PROCESS FOR THE PRODUCTION OF LOW SULFUR DIESEL AND HIGH OCTANE NAPHTHA

BACKGROUND OF THE INVENTION

This invention relates to a process for the production of low sulfur diesel and high octane naphtha. More specifically, the invention is an integrated process for the hydrodesulfurization of middle distillate hydrocarbon streams and the hydrocracking of highly aromatic hydrocarbon streams.

Petroleum refiners produce desirable products such as turbine fuel, diesel fuel and middle distillates, as well as naphtha and gasoline, by hydrocracking a hydrocarbon feedstock derived from crude oil, for example. Feedstocks most often subjected to hydrocracking are gas oils and heavy gas oils recovered from crude oil by distillation. Refiners also subject middle distillate hydrocarbon streams to hydrodesulfurization. Although a wide variety of process flow schemes, operating conditions and catalysts have been used in commercial activities, there is always a demand for new hydroprocessing methods which provide lower costs, more valuable product yields and improved operability.

INFORMATION DISCLOSURE

U.S. Pat. No. 4,943,366 (Fischer et al.) discloses a hydrocracking process for converting highly aromatic, substantially dealkylated feedstock into high octane gasoline.

BRIEF SUMMARY OF THE INVENTION

The present invention is an integrated process for the production of low sulfur diesel and high octane naphtha. The process of the present invention utilizes a middle distillate hydrocarbon stream and a highly aromatic hydrocarbon stream. The middle distillate hydrocarbon feedstock is reacted with a hydrogen-rich gaseous stream in a hydrodesulfurization reaction zone and the highly aromatic hydrocarbon stream is reacted with a hydrogen-rich gaseous stream in a hydrocracking zone. The resulting effluents from the two zones are introduced into separate high pressure vapor liquid separators to produce a hydrogen-rich recycle gas and a first liquid stream containing desulfurized diesel from the effluent from the hydrodesulfurization reaction zone and a second liquid stream containing diesel and high octane naphtha from the effluent from the hydrocracking zone.

The use of separate high pressure vapor liquid separators serves to maintain and isolate the high octane naphtha produced in the hydrocracking zone thereby maximizing the value of the hydrocarbon streams produced.

Other embodiments of the present invention encompass further details such as detailed descriptions of feedstocks, hydrodesulfurization catalysts, hydrocracking catalysts, and preferred operating conditions, all of which are hereinafter disclosed in the following discussion of each of these facets of the invention.

BRIEF DESCRIPTION OF THE DRAWING

The drawing is a simplified process flow diagram of a preferred embodiment of the present invention. The drawing is intended to be schematically illustrative of the present invention and not be a limitation thereof.

DETAILED DESCRIPTION OF THE INVENTION

The present invention is an integrated process for the hydrodesulfurization of middle distillate hydrocarbon streams and the hydrocracking of highly aromatic hydrocarbon streams. Preferred feedstocks to the hydrodesulfurization reaction zone include distillate hydrocarbons boiling at a temperature greater than about 149° C. (300° F.) and more preferably boiling in the range from about 149° C. (300° F.) to about 399° C. (750° F.). Distillate hydrocarbon feedstocks are most often recovered from crude oil by distillation. However, distillate hydrocarbons may be utilized from any convenient source such as tar sand extract and gas to liquids for example. Furthermore, the distillate hydrocarbon feedstocks may contain from about 0.1 to about 4 weight percent sulfur.

The preferred highly aromatic hydrocarbon feedstocks boil in the range from about 149° C. (300° F.) to about 343° C. (650° F.). Highly aromatic, substantially dealkylated hydrocarbons are produced during the fluid catalytic cracking (FCC) of vacuum gas oils to produce high octane gasoline boiling range hydrocarbons. FCC is a thermally severe process which is operated without the presence of added hydrogen to reject carbon to coke and to produce residual fractions. During catalytic cracking, the high molecular weight feedstock disproportionates into relatively hydrogen-rich light liquids and aromatic, hydrogen-deficient heavier distillates and residues. The catalytic cracking in the absence of hydrogen does not provide significant desulfurization nor is the nitrogen content of the feed selectively rejected with the coke. The sulfur and nitrogen therefore concentrate in heavier cracking products and produces significant quantities of highly aromatic, hydrogen-deficient middle and heavy distillates with high sulfur and nitrogen levels. Recycling these liquids to the catalytic cracker is not an attractive option. A typical light cycle oil (LCO) from an FCC contains about 3 weight percent sulfur, about 700 wppm nitrogen and greater than about 80 volume percent aromatics. Present market requirements make refractory product streams such as light cycle oil particularly difficult to dispose of as commercially valuable products.

In one embodiment of the present invention, a highly aromatic, hydrogen deficient and substantially dealkylated hydrocarbon feedstock is introduced into a hydrocracking zone. The hydrocracking zone may contain one or more beds of the same or different catalyst. In one embodiment the preferred hydrocracking catalysts utilize amorphous bases or low-level zeolite bases combined with one or more Group VIII or Group VIB metal hydrogenating components. In another embodiment the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms ($10^{-10}$ meters). Its preferred to employ zeolites having a silica/alumina mole ratio between about 3 and 12. Suitable zeolites found in nature include, for example, mordenite, stillbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms ($10^{-10}$ meters), wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 371°-648° C. (700°-1200° F.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking of the hydrocarbonaceous feedstock in contact with a hydrocracking catalyst is conducted in the presence of hydrogen and preferably at hydrocracking reactor conditions which include a temperature from about 260° C. (500° F.) to about 426° C. (800° F.), a pressure from about 7.0 MPa (1000 psig) to about 10.5 MPa (1500 psig), a liquid hourly space velocity (LHSV) from about 0.1 to about 30 $hr^{-1}$, and a hydrogen circulation rate from about 2000 (337 normal $m^3/m^3$) to about 25,000 (4200 normal $m^3/m^3$) standard cubic feet per barrel.

The hydrocracking zone preferably contains hydrotreating catalyst upstream of the hydrocracking catalyst to catalytically remove nitrogen and sulfur from the hydrocarbonaceous feedstock prior to hydrocracking. Any suitable hydrotreating and/or hydrodesulfurization catalyst may be used in the present invention. The hydrotreating step may be operated at conditions which generally fall within the preferred operating conditions of the hydrocracking step and may be readily selected depending upon the particular feedstock.

The resulting effluent from the hydrocracking zone is preferably introduced into a hot high pressure vapor liquid separator operated at a pressure substantially equal to the hydrocracking zone and a temperature in the range from about 260° C. (500° F.) to about 370° C. (700° F.). A vaporous hydrocarbonaceous stream containing naphtha, diesel and hydrogen is removed from the hot high pressure vapor liquid separator and introduced into a post treat reaction zone to selectively remove sulfur which is preferably operated at a pressure from about 7.0 MPa (1000 psig) to about 10.5 MPa (1500 psig) and a temperature from about 260° C. (500° F.) to about 370° C. (700° F.). The resulting effluent from the post treat reaction zone is preferably contacted with an aqueous stream to dissolve any ammonium salts, partially condensed and then introduced into a first cold vapor-liquid separator to provide a hydrogen rich gaseous stream and a liquid hydrocarbonaceous stream containing naphtha and diesel which stream is introduced into a first cold flash drum. The first cold flash drum provides a gaseous stream comprising normally gaseous hydrocarbons and a liquid hydrocarbon stream containing high octane naphtha and low sulfur diesel. A liquid hydrocarbonaceous stream is removed from the hot high pressure vapor liquid separator and introduced into a hot flash drum which is preferably operated at a pressure from about 800 kPa (100 psig) to about 3500 kPa (500 psig) and a temperature from about 260° C. (500° F.) to about 370° C. (700° F.) to produce a liquid hydrocarbonaceous stream containing diesel boiling range hydrocarbons which is subsequently fractionated, and a hydrocarbonaceous vapor stream which is cooled, partially condensed and introduced into the first cold flash drum.

In one embodiment of the present invention, a distillate hydrocarbon boiling at a temperature greater than about 149° C. (300° F.) is introduced into a desulfurization reaction zone together with a hydrogen-rich make-up stream at desulfurization reaction conditions. Preferred desulfurization reaction conditions include a temperature from about 260° C. (500° F.) to about 426° C. (800° F.), a pressure from about 7.0 MPa (1000 psig) to about 10.5 MPa (1500 psig), and a liquid hourly space velocity from about 0.1 hr-1 to about 10 $hr^{-1}$.

Suitable desulfurization catalysts for use in the present invention are any known convention desulfurization catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable desulfurization catalysts include zeolitic catalysts, as well as noble metal catalysts where the noble metal is selected from palladium and platinum. It is within the scope of the present invention that more than one type of desulfurization catalyst be used in the same reaction vessel. Two or more catalyst beds and one or more quench points may be utilized in the reaction vessel or vessels. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent.

The resulting effluent from the desulfurization reaction zone is preferably contacted with an aqueous stream, partially condensed, and then introduced into a second high pressure vapor-liquid separator operated at a pressure substantially equal to the desulfurization reaction zone and a temperature in the range from about 38° C. (100° F.) to about 71° C. (160° F.). An aqueous stream is recovered from the second high pressure vapor liquid separator. A hydrogen-rich gaseous stream is removed from the second high pressure vapor liquid separator and admixed with the hereinabove described hydrogen-rich gaseous stream recovered from the first high pressure vapor liquid separator.

During the hydrodesulfurization of a distillate hydrocarbon feedstock, the primary function is to remove sulfur from hydrocarbonaceous compounds, however, some lower boiling hydrocarbons are produced. When the hydrodesulfurization feedstock boils above the naphtha range, the hydrodesulfurization reaction zone effluent contains naphtha and has a low octane rating. When a highly aromatic, substantially dealkylated hydrocarbon feedstock is hydrocracked, the resulting hydrocarbon stream contains high octane naphtha. Therefore, in order to preserve a hydrocarbon stream containing high octane naphtha without diluting this stream with another hydrocarbon stream containing low octane naphtha, two high pressure vapor liquid separators are used in the integrated process of the present invention. Even though the liquid hydrocarbon effluents are maintained in separate and parallel trains, the hydrogen-rich gaseous streams which are recovered from each conversion zone are recovered, admixed and compressed as a single hydrogen-rich gaseous recycle stream.

In a preferred embodiment, a liquid hydrocarbonaceous stream from each of the first and the second vapor liquid separators is introduced into a first and a second cold flash drum respectively, operated at a temperature from about 38° C. (100° F.) to about 71° C. (160° F.) and a pressure from about 800 kPa (100 psig) to about 3500 kPa (500 psig) to provide gaseous streams containing hydrogen and normally gaseous hydrocarbons.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

Referring now to the drawing, a distillate hydrocarbon feedstock is introduced into the process via line 1 and is admixed with a hydrogen-rich recycle gas stream which is introduced via line 21. The resulting admixture is transported via line 2 and introduced into hydrodesulfurization reaction zone 3. A resulting effluent from hydrodesulfurization reaction zone 3 is carried via line 4 and is admixed with an aqueous stream provided via line 5 and the resulting admixture is carried via line 6 and introduced into heat exchanger 7. A resulting cooled and partially condensed stream from heat exchanger 7 is carried via line 8 and introduced into cold vapor liquid separator 9. A light cycle oil feedstock provided via line 23 is admixed with a hydrogen-rich recycle gas stream provided via line 22 and the resulting admixture is introduced via line 24 into hydrotreating reaction zone 25. A resulting effluent from hydrotreating reaction zone 25 is carried via line 26 and introduced into hydrocracking zone 27. A resulting effluent from hydrocracking zone 27 is transported via line 28 and introduced into hot vapor liquid separator 29. A liquid stream is removed from hot vapor liquid separator 29 via line 44 and introduced into hot flash drum 45. A liquid hydrocarbonaceous stream is removed from hot flash drum 45 via line 46 and introduced into a fractionation zone (not shown). A vaporous hydrocarbonaceous stream is removed from hot flash drum 45 via line 47 and introduced into heat exchanger 48. The resulting cooled effluent stream is removed from heat exchanger 48 via line 49 and introduced into cold flash drum 39 via lines 49 and 51. A vaporous hydrocarbonaceous stream containing hydrogen is removed from hot vapor liquid separator 29 via line 30 and introduced into post-treat reactor 31. A resulting effluent is removed from post-treat reactor 31 via line 32 and is admixed with an aqueous stream provided via line 33 and the resulting admixture is carried via line 34 and introduced into heat exchanger 35. A resulting cooled and partially condensed stream is removed from heat exchanger 35 via line 36 and introduced into cold vapor liquid separator 37. A hydrogen-rich gaseous stream is removed from cold vapor liquid separator 9 via line 10 and a hydrogen-rich gaseous stream is removed from cold vapor liquid separator 37 via line 11 and the resulting admixture thereof is carried via line 12 and introduced into absorption zone 13. A lean amine stream carried via 14 is introduced into absorption zone 13 and a rich amine stream containing hydrogen sulfide is removed from absorption zone 13 via line 15 and recovered. A hydrogen-rich gaseous stream having a reduced concentration of hydrogen sulfide is removed from absorption zone 13 via line 16 and introduced into compressor 17. A compressed hydrogen-rich gaseous stream is carried from compressor 17 via line 18 and is admixed with a hydrogen makeup stream carried via line 19 and the resulting admixture is subsequently carried via line 20. A first portion of the hydrogen-rich recycle gas carried via line 20 is further transported via lines 21 and 2 and introduced into hydrodesulfurization reaction zone 3 as described hereinabove. Another portion of the hydrogen-rich gaseous recycle stream is transported via lines 22 and 24 and introduced into hydrotreating reaction zone 25 as described hereinabove. A liquid hydrocarbon stream is removed from cold vapor liquid separator 9 via line 50 and introduced into cold flash drum 52 via line 50. A liquid hydrocarbon stream having a reduced concentration of sulfur is removed from cold flash drum 52 via line 57 and recovered. A hydrocarbon stream containing low sulfur diesel and high octane naphtha is removed from cold vapor liquid separator 37 via line 38, admixed with a hydrocarbon stream provided by line 49 and introduced into cold flash drum 39 via line 51. A liquid hydrocarbon stream containing low sulfur diesel and high octane naphtha is removed from cold flash drum 39 via line 43 and recovered. An aqueous stream is removed from cold vapor liquid separator 9 via line 54 and an aqueous stream is removed from cold vapor liquid separator 37 via line 53 and the resulting admixture thereof is carried via line 55 and introduced into cold flash drum 52. An aqueous stream containing inorganic salts is removed from cold flash drum 52 via line 56 and recovered. A gaseous stream containing normally gaseous hydrocarbons is removed from cold flash drum 52 via line 40 and another gaseous stream containing normally gaseous hydrocarbons is removed from cold flash drum 39 via line 41 and the resulting admixture thereof is carried via line 42 and recovered.

The foregoing description and drawing clearly illustrate the advantages encompassed by the process of the present invention and the benefits to be afforded with the use thereof.

What is claimed is:

1. An integrated process for the hydrocracking of a feedstock comprising light cycle oil (LCO) and hydrotreating a distillate hydrocarbon stream which process comprises:

a) reacting a distillate hydrocarbon feedstock having a boiling range greater than about 149° C. (300° F.) and a hydrogen-rich gaseous stream in a hydrodesulfurization reaction zone containing desulfurization catalyst to produce a hydrodesulfurization reaction zone effluent stream containing hydrocarbons having a reduced concentration of sulfur;

b) reacting a highly aromatic, substantially dealkylated hydrocarbon feedstock in a hydrocracking zone containing hydrocracking catalyst to produce a hydrocracking zone effluent stream comprising monocyclic aromatic compounds boiling in the naphtha range;

c) introducing at least a portion of the monocyclic compounds boiling in the naphtha range produced in step (b) into a first vapor liquid separator;

d) introducing the hydrodesulfurization reaction zone effluent stream containing hydrocarbons having a reduced concentration of sulfur produced in step (a) into a second vapor liquid separator; and e) separating a liquid hydrocarbonaceous stream from the first vapor liquid separator to produce high octane naphtha.

2. The process of claim 1 wherein the first vapor liquid separator and the second vapor liquid separator produce a hydrogen-rich gaseous stream.

3. The process of claim 2 wherein at least a portion of the hydrogen-rich gaseous stream is recycled to the hydrodesulfurization reaction zone and the hydrocracking zone.

4. The process of claim 1 wherein the highly aromatic, substantially dealkylated hydrocarbon feedstock comprises hydrocarbons boiling in the range from about 149° C. (300° F.) to about 343° C. (650° F.).

5. The process of claim 1 wherein the distillate hydrocarbon feedstock boils in the range from about 149° C. (300° F.) to about 399° C. (750° F.).

6. The process of claim 1 wherein the highly aromatic, substantially dealkylated hydrocarbon feedstock comprises light cycle oil.

7. The process of claim 1 wherein the hydrodesulfurization reaction zone is operated at conditions including a pressure from about 7.0 MPa (1000 psig) to about 10.5 MPA (1500 psig) and a temperature from about 260° C. (500° F.) to about 426° C. (800° F.).

8. The process of claim 1 wherein the hydrocracking zone is operated at conditions including a pressure from about 7.0 MPa (1000 psig) to about 10.5 MPa (1500 psig) and a temperature from about 260° C. (500° F.) to about 426° C. (800° F.).

9. The process of claim 1 wherein step (e) is performed in at least one fractionation zone.

10. The process of claim 1 wherein the first and the second vapor liquid separators are operated at a pressure from about 7.0 MPa (1000 psig) to about 10.5 MPa (1500 psig) and a temperature from about 4.4° C. (40° F.) to about 71° C. (160° F.).

11. An integrated process for the hydrocracking of a feedstock comprising light cycle oil (LCO) and hydrotreating a distillate hydrocarbon stream which process comprises:

a) reacting a distillate hydrocarbon feedstock boiling in the range from about 149° C. (300° F.) to about 399° C. (750° F.) in a hydrodesulfurization reaction zone containing desulfurization catalyst operated at conditions including a pressure from about 7.0 MPa (1000 psig) to about 10.5 MPa (1500 psig) and a temperature from about 260° C. (500° F.) to about 426° C. (800° F.) to produce a hydrodesulfurization reaction zone effluent stream containing hydrocarbons having a reduced concentration of sulfur;

b) reacting a highly aromatic, substantially dealkylated hydrocarbon feedstock comprising light cycle oil in a hydrocracking zone containing hydrocracking catalyst operated at conditions including a pressure from about 7.0 MPa (1000 psig) to about 10.5 MPa (1500 psig) and a temperature from about 260° C. (500° F.) to about 426° C. (800° F.) to produce a hydrocracking zone effluent stream comprising monocyclic aromatic compounds boiling in the naphtha range;

c) introducing at least a portion of the monocyclic compounds boiling in the naphtha range produced in step (b) into a first vapor liquid separator;

d) introducing the hydrodesulfurization reaction zone effluent stream containing hydrocarbons having a reduced concentration of sulfur produced in step (a) into a second vapor liquid separator; and e) separating a liquid hydrocarbonaceous stream from the first vapor liquid separator to produce high octane naphtha.

12. The process of claim 11 wherein the first vapor liquid separator and the second vapor liquid separator produce a hydrogen-rich gaseous stream.

13. The process of claim 12 wherein at least a portion of the hydrogen-rich gaseous stream is recycled to the hydrodesulfurization reaction zone and the hydrocracking zone.

14. The process of claim 11 wherein the highly aromatic, substantially dealkylated hydrocarbon feedstock comprises light cycle oil.

15. The process of claim 11 wherein step (e) is performed in at least one fractionation zone.

16. The process of claim 11 wherein the first and the second vapor liquid separators are operated at a pressure from about 7.0 MPa (1000 psig) to about 10.5 MPa (1500 psig) and a temperature from about 4.4° C. (40° F.) to about 71° C. (160° F.).

17. An integrated process for the hydrocracking of a feedstock comprising light cycle oil (LCO) and hydrotreating a distillate hydrocarbon stream which process comprises:

a) reacting a distillate hydrocarbon feedstock boiling in the rang from about 149° C. (300° F.) to about 399° C. (750° F.) in a hydrodesulfurization reaction zone containing desulfurization catalyst operated at conditions including a pressure from about 7.0 MPa (1000 psig) to about 10.5 MPa (1500 psig) and a temperature from about 260° C. (500° F.) to about 426° C. (800° F.) to produce a hydrodesulfurization reaction zone effluent stream containing hydrocarbons having a reduced concentration of sulfur;

b) reacting a highly aromatic, substantially dealkylated hydrocarbon feedstock comprising light cycle oil in a hydrocracking zone containing hydrocracking catalyst operated at conditions including a pressure from about 7.0 MPa (1000 psig) to about 10.5 MPa (1500 psig) and a temperature from about 260° C. (500° F.) to about 426° C. (800° F.) to produce a hydrocracking zone effluent stream comprising monocyclic aromatic compounds boiling in the naphtha range;

c) introducing at least a portion of the monocyclic compounds boiling in the naphtha range produced in step (b) into a first vapor liquid separator;

d) introducing the hydrodesulfurization reaction zone effluent stream containing hydrocarbons having a reduced concentration of sulfur produced in step (a) into a second vapor liquid separator;

e) separating a liquid hydrocarbonaceous stream from the first vapor liquid separator to produce high octane naphtha;

f) recovering a hydrogen-rich gaseous stream from the first vapor liquid separator and the second vapor liquid separator; and g) recycling at least a portion of the hydrogen-rich gaseous stream recovered in step (f) to the hydrodesulfurization reaction zone and the hydrocracking zone.

* * * * *